US006571873B2

(12) United States Patent
Maus

(10) Patent No.: US 6,571,873 B2
(45) Date of Patent: Jun. 3, 2003

(54) METHOD FOR CONTROLLING BOTTOM-HOLE PRESSURE DURING DUAL-GRADIENT DRILLING

(75) Inventor: L. Donald Maus, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/079,170

(22) Filed: Feb. 20, 2002

(65) Prior Publication Data

US 2002/0129943 A1 Sep. 19, 2002

Related U.S. Application Data

(60) Provisional application No. 60/271,244, filed on Feb. 23, 2001.

(51) Int. Cl.[7] ..... E21B 47/06; E21B 7/12

(52) U.S. Cl. ..... 166/250.07; 166/358; 175/5

(58) Field of Search ..... 166/250.07, 358; 175/5, 65, 71

(56) References Cited

U.S. PATENT DOCUMENTS

| | | | | |
|---|---|---|---|---|
| 2,512,783 A | | 6/1950 | Tucker | 255/2 |
| 2,808,230 A | | 10/1957 | McNeill et al. | 255/2.5 |
| 2,923,531 A | | 2/1960 | Bauer et al. | 255/2.5 |
| 3,434,550 A | | 3/1969 | Townsend, Jr. | 175/5 |
| 3,465,817 A | | 9/1969 | Vincent | 166/0.5 |
| 3,603,409 A | | 9/1971 | Watkins | 175/7 |
| 3,815,673 A | | 6/1974 | Bruce | 166/0.5 |
| 3,955,411 A | | 5/1976 | Lawson, Jr. | 73/155 |
| 4,046,191 A | * | 9/1977 | Neath | 166/352 |
| 4,060,140 A | | 11/1977 | Barrington | 175/7 |
| 4,091,881 A | | 5/1978 | Maus | 175/7 |
| 4,099,583 A | | 7/1978 | Maus | 175/7 |
| 4,134,461 A | | 1/1979 | Blomsma | 175/9 |
| 4,210,208 A | | 7/1980 | Shanks | 166/352 |
| 4,291,772 A | | 9/1981 | Beynet | 175/5 |
| 4,813,495 A | * | 3/1989 | Leach | 166/358 |
| 5,873,420 A | | 2/1999 | Gearhart | 175/25 |
| 6,065,550 A | | 5/2000 | Gardes | 175/62 |
| 6,328,107 B1 | | 12/2001 | Maus | 166/335 |

FOREIGN PATENT DOCUMENTS

| | | |
|---|---|---|
| CA | 2148969 | 11/1996 |
| GB | 1132687 | 11/1968 |
| WO | WO 99/15758 | 4/1999 |
| WO | WO 99/18327 | 4/1999 |
| WO | WO 99/49172 | 9/1999 |
| WO | WO 00/04269 | 1/2000 |

OTHER PUBLICATIONS

Brookey, Tom, 1998, "Micro–Bubbles"; New Aphron Drill–In Fluid Technique Reduces Formation Damages in Horizontal Wells, SPE 39589, Feb. 18–19, 1998, pp. 645–656.

Choe, Jonggeun, 1999, "Analysis of Riserless Drilling and Well–Control Hydraulics", SPE Drill & Completions, SPE 55056, Mar. 1999, pp. 71–81.

(List continued on next page.)

*Primary Examiner*—David Bagnell
*Assistant Examiner*—Brian Halford
(74) *Attorney, Agent, or Firm*—Gary D. Lawson

(57) ABSTRACT

A method is disclosed for controlling pressure in a wellbore during drilling. The method includes operating a drilling system to have a first fluid pressure gradient inside a drillstring extending from the earth's surface to a drill bit at the bottom of the wellbore. The drilling system has a second fluid pressure gradient lower than the first fluid pressure gradient in an annular space between the drillstring and the wellbore from a selected depth in the wellbore to the earth's surface. Introduction of drilling fluid to the inside of the drillstring is stopped, and fluid flow in the annular space from a point below the selected depth to a point above the selected depth is selectively controlled to cause a substantially constant fluid pressure at a predetermined depth in the wellbore.

8 Claims, 7 Drawing Sheets

OTHER PUBLICATIONS

Gaddy, Dean E., 1999, "Industry Group Studies Dual–Gradient Drilling", Oil & Gas Journal, Aug. 16, 1999, pp. 32–34.
Gault, Allen, 1996, "Riserless Drilling: Circumventing the Size/Cost Cycle in Deepwater", Offshore, May 1996, pp. 49–54.
Goldsmith, Riley, 1998, "MudLift Drilling System Operations", OTC 8751, 1998 Offshore Tech. Conference, Houston, TX, May 4–7, 1998, pp. 317–325.
Lopes, Clovis A., et al, 1997, "Feasibility Study of a Dual Density Mud System for Deepwater Drilling Operations", 1997 Offshore Tech. Conf., Houston, TX, May 5–8, 1997, pp. 257–266.
Lopes, Clovis A., et al, 1997, "The Dual Density Riser Solution", SPE/IADC Drilling Conference, Amsterdam, SPE/IADC 27628, Mar. 6–7, 1997, pp. 479–487.
Medley, George H., et al, 1995, "Use of Hollow Glass Spheres for Underbalanced Drilling Fluids", SPE Tech. Conference, Dallas, TX, SPE 30500, Oct. 22–25, 1995, pp. 511–520.
Medley, George H., et al, 1995, "Development and Testing of Underbalanced Drilling Products", Topical Report, DOE/MC/31197–5129, Sep. 1995.
Nessa, D. O., et al, 1997, "Offshore Underbalanced Drilling System Could Revive Field Developments—Part I", World Oil, Jul. 1997, pp. 61–66.
Nessa, D. O., et al, 1997, "Offshore Underbalanced Drilling System Could Revive Field Developments—Part II", World Oil, Oct. 1997, pp. 83–88.
Sangesland, S., et al, 1998, "Riser Lift Pump for Deep Water Drilling", IADO/SPE Asia Pacific Drilling Conference, Jakarta, Indonesia, Sep. 7–9, 1998, IADC/SPE 47821, pp. 299–309.
Shaughnessy, J. M. & Herrmann, Robert P., 1998, "Concentric Riser Will Reduce Mud Weight Margins, Improve Gas–Handling Safety", Oil & Gas Journal, Nov. 2, 1998, pp. 54–58.

Snyder, R. E., 1998, "Riserless Drilling Project Develops Critical New Technology", World Oil, Jan. 1998, pp. 73–77.

Westermark, R. V., 1986, "Drilling With a Parasite Aerating String in the Disturbed Belt, Gallatin County, Montana", IADC/SPE 14734, IADC/SPE 1986 Drilling Conference, Dallas, TX, Feb. 10–12, 1986, pp. 137–143.

Gault, Allen, 1996, "Riserless Drilling: Circumventing the Size/Cost Cycle in Deepwater", Offshore, May 1996, pp. 49–54.

Goldsmith, Riley, 1998, "MudLift Drilling System Operations", OTC 8751, 1998 Offshore Tech. Conference, Houston, TX, May 4–7, 1998, pp. 317–325.

Lopes, Clovis A., et al, 1997, "Feasibility Study of a Dual Density Mud System for Deepwater Drilling Operations", 1997 Offshore Tech. Conf., Houston, TX, May 5–8, 1997, pp. 257–266.

Lopes, Clovis A., et al, 1997, "The Dual Density Riser Solution", SPE/IADC Drilling Conference, Amsterdam, SPE/IADC 27628, Mar. 6–7, 1997, pp. 479–487.

Medley, George H., et al, 1995, "Use of Hollow Glass Spheres for Underbalanced Drilling Fluids", SPE Tech. Conference, Dallas, TX, Oct. 22–25, 1995, pp. 511–520.

* cited by examiner

METHOD FOR CONTROLLING BOTTOM-HOLE PRESSURE DURING DUAL-GRADIENT DRILLING

CROSS REFERENCE TO RELATED APPLICATION

This application claims priority benefit from U.S. provisional application No. 60/271,244 filed on Feb. 23, 2001.

FIELD OF THE INVENTION

The invention is related to the field of wellbore drilling. More specifically, the invention is related to a method for wellbore drilling in deep ocean water.

BACKGROUND OF THE INVENTION

In many oil and gas provinces, reservoirs have reached a stage where it is difficult to maintain production rates that can support daily operational and maintenance costs. Infrastructure platform and pipeline systems are in place, but larger fields become more and more dependent on fewer wells producing at lower rates. As a result, much exploration effort is directed at hydrocarbon production from beneath very deep ocean water.

Geological and well-design barriers will eventually prohibit access to ultra-deep water basins using conventional drilling technologies. For example, as water depths increase, so does the number of casing strings needed to overcome problems associated with shallow-water flows, weak formations, lost circulation, underground blowouts, sloughing shale, and high-pressure zones. As deeper formation prospects require the use of more contingency casing strings, conventionally-drilled wellbores eventually may reach a point where progressively smaller wellbore diameters hinder drilling progress or constrain production rates.

One solution to overcome these problems is a drilling system called dual-gradient-drilling, ("DGD"). DGD can be used for drilling wells in deep ocean water. In DGD, the effects within the well of a column of returning drilling mud from the sea floor to the surface of the ocean are controlled so as to be substantially the same as if the returning drilling mud column were seawater. This may be accomplished by using a sea floor pump in the mud return system, or by injecting a low-density material near the base of a marine riser.

FIG. 1 shows a diagram of prior art DGD, more specifically for extended-reach or long horizontal well drilling. Typically, a system with DGD circulates drilling fluids down (22) a drill string (2), out a bit (4), up the well annulus (18), through a riser (6) to a floating drilling rig 14 at the surface 32 of a body of seawater, and back to an active mud system (not shown). At the mud line (8) is a blowout preventer (BOP) stack 38 which can close and seal an annular space between the drill string (2) and the riser (6). When the BOP (38) is closed, it stops the returning mud (24) from flowing up the riser (6),. To advance fluid flow up (20) the riser (6), a pump (130) introduces gas (21) or other low density fluid through a boost line (12) to lift the returning mud up the riser (6)). Typically, the amount of gas or low density fluid introduced into the boost line (12) is selected to provide a pressure gradient in the riser (6) equivalent to having the riser (6) filled with sea water. Below the mud line (8), a part of a wellbore is typically cased (24) to prevent the wall of the wellbore from caving in, to prevent movement of fluids from one formation to another, and to improve the efficiency of extracting petroleum if the well is productive. In a reservoir (26), however, the wellbore may be "open hole" (28), meaning it is uncased. At the wellhead, commonly, a blowout preventer stack (38) and several valves (30) are installed to prevent the escape of pressure either in the annular space between the casing (24) and the drilling string (2) or in open hole during drilling or completion operations.

In designing the circulating system, considerations include annular bottom-hole circulating pressures, hole cleaning requirements, the bottom hole assembly requirements, reservoir fluid influx, fluid regime and economics. In addition, it is important to optimize the bottom-hole pressure, which is affected by many interrelated parameters, for example, types and rates of injection fluids, performance of reservoir fluid inflow and drill string movement. All of these parameters affect bottom hole pressure.

Even though DGD enables drilling in deep water, in long horizontal wells, a significant fraction of the bottom hole pressure results from circulation pressure needed to overcome frictional pressure loss in the return mud circulation system. This pressure loss, and the circulation pressure needed to overcome it, increase as the length of well increases. However, in horizontal wells, the vertical depth of bottom of the well is about the same over the length of the horizontal segment of the well. The fracture pressure therefore does not increase with measured wellbore depth. As a result, the bottom hole pressure eventually will exceed a safe amount, even when using DGD techniques.

SUMMARY OF THE INVENTION

In one aspect, the present invention provides a method for drilling deeper than is possible using conventional drilling techniques in deep ocean water by controlling bottom-hole pressure during dual-gradient drilling.

In one embodiment of a method according to the invention, a blowout preventer is closed to stop fluid flow through the blowout preventer, which seals an annular space between a wellbore and a drill string therein, and to divert the fluid flow through a bypass conduit. This is followed by stopping introduction of fluid into the interior of the drill string during the drilling operation. Through the bypass conduit in this embodiment, the lower end of a riser is hydraulically coupled to the wellbore at a point below the preventer. The riser in this embodiment extends from the blowout preventer to a drilling rig at the earth's surface. Passage of fluid flow is selectively controlled, using a subsea choke operatively coupled to the bypass conduit. The fluid flow is regulated to maintain a substantially constant pressure at a selected depth in the wellbore.

This invention is generally applicable to any DGD system, regardless of the method used to maintain wellbore annulus pressure at the mud line. It is particularly applicable to DGD systems that employ gas or some other diluent to lighten a column of mud in the riser.

Other aspects and advantages of the invention will be apparent from the following description and the appended claims.

DETAILED DESCRIPTION OF THE INVENTION

Figure 1:
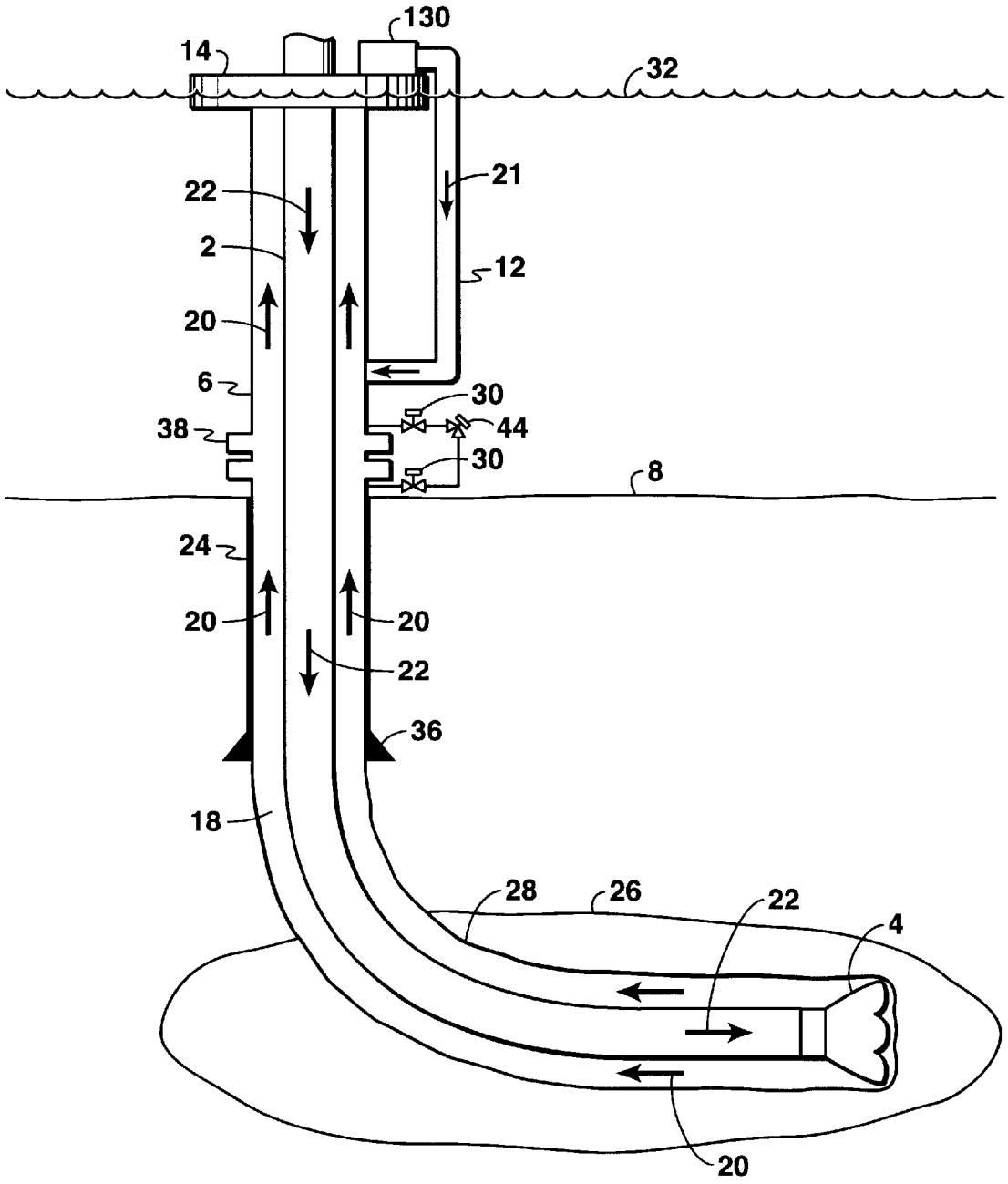
FIG. 1 (Prior Art)
FIG. 1 shows one example of a prior art DGD system.

Exemplary embodiments of the invention will be described with reference to the accompanying drawings. Like items in the drawings are shown with the same reference numbers.

The present invention provides a solution to certain problems in deepwater drilling, more specifically extended-reach or long horizontal well drilling. In general, dual-gradient-drilling (DGD) allows drilling in deep water with fewer casing strings than possible using conventional drilling techniques. This enables drilling wells in a shorter time. However, in "open-hole" horizontal wells, full circulating bottom hole pressure reaches the drilling limit relatively early. This limit defines either the point at which an additional string of casing must be set or the maximum reach for this well. When casing is set, additional drilling may not be possible, especially in highly inclined and horizontal wells.

Figure 2C:
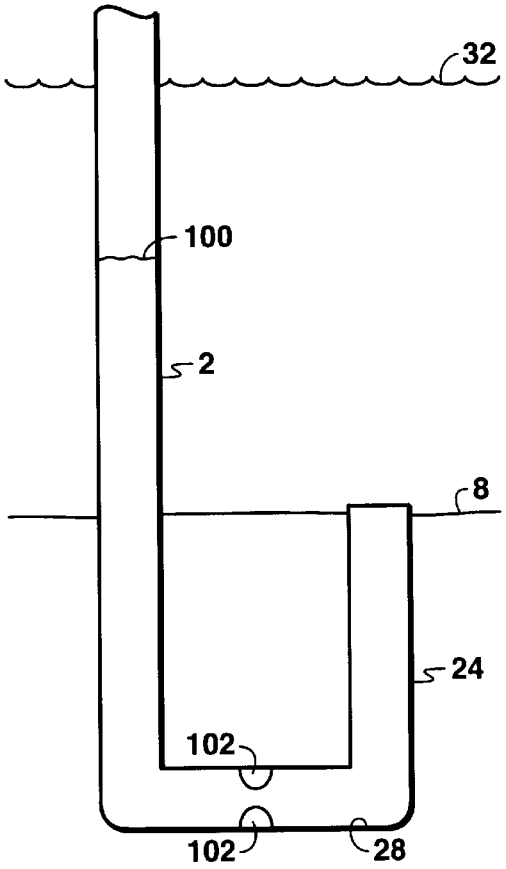
FIGS. 2*a*, 2*b*, and 2*c* show a diagram to depict mud fall effect.
Figure 2B:
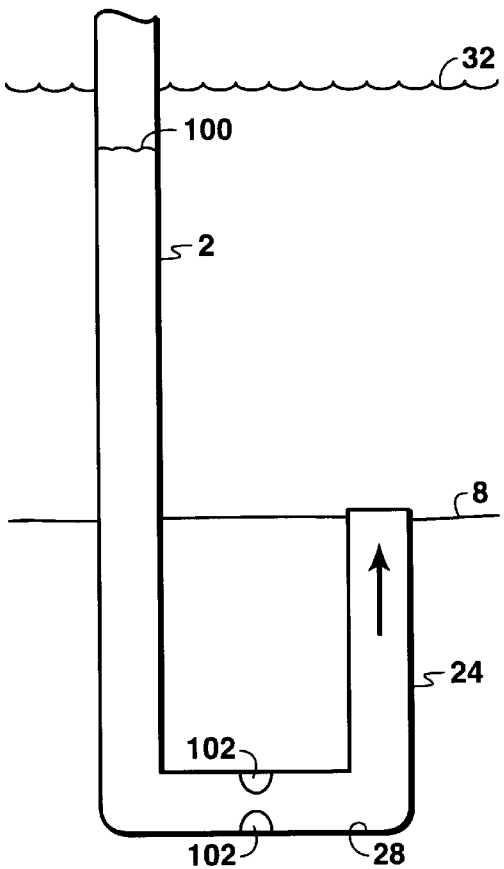
Figure 2A:
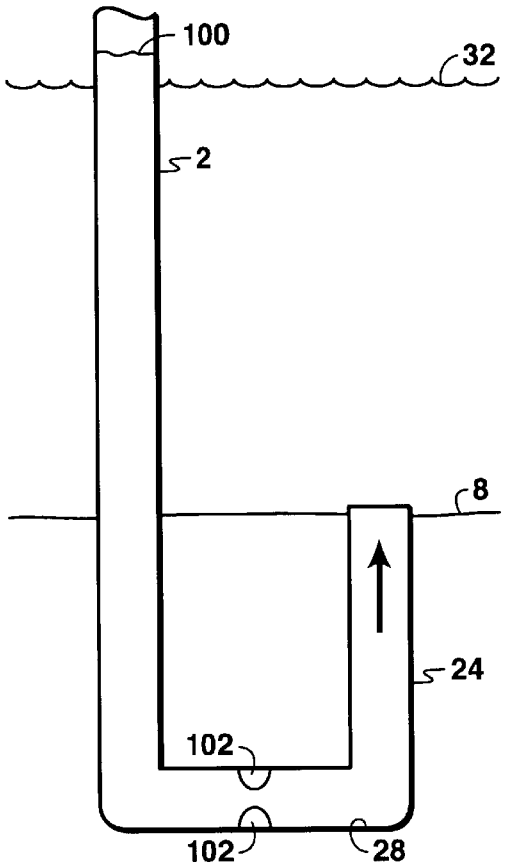

In DGD, during normal circulation of the drilling mud, there is a hydrostatic imbalance between the mud column in the drill string ((2) in FIG. 1) and the mud column in the wellbore ((24, 28) in FIG. 1) and drilling riser ((6) in FIG. 1). This is illustrated in FIGS. 2*a*–2*c*. No drilling riser is shown in FIGS. 2*a* through 2*c* to emphasize that the annulus pressure at the base of riser, $P_{rb}$, in this embodiment is maintained equal to the pressure of the surrounding sea water, $P_{sw}$, as is typical for DGD. FIG. 2*a* depicts circulating conditions while mud is being pumped. The frictional pressure losses inside the drill string (2), across the bit nozzles (102) and in the wellbore annulus are sufficient to overcome the hydrostatic imbalance and to maintain a full drill string and a positive mud pump pressure. However, once the mud pump (not shown) is stopped, the hydrostatic imbalance causes the mud column (100) in the drill string (2) to fall, as illustrated in FIG. 2*b*. Mud will continue to flow up the riser and out from the well until hydrostatic equilibrium is reached between the interior of the drill string (2) and the wellbore, as shown at 100 in FIG. 2*c*. The present invention utilizes this so called "mud fall" phenomenon to advantage.

Figure 3:
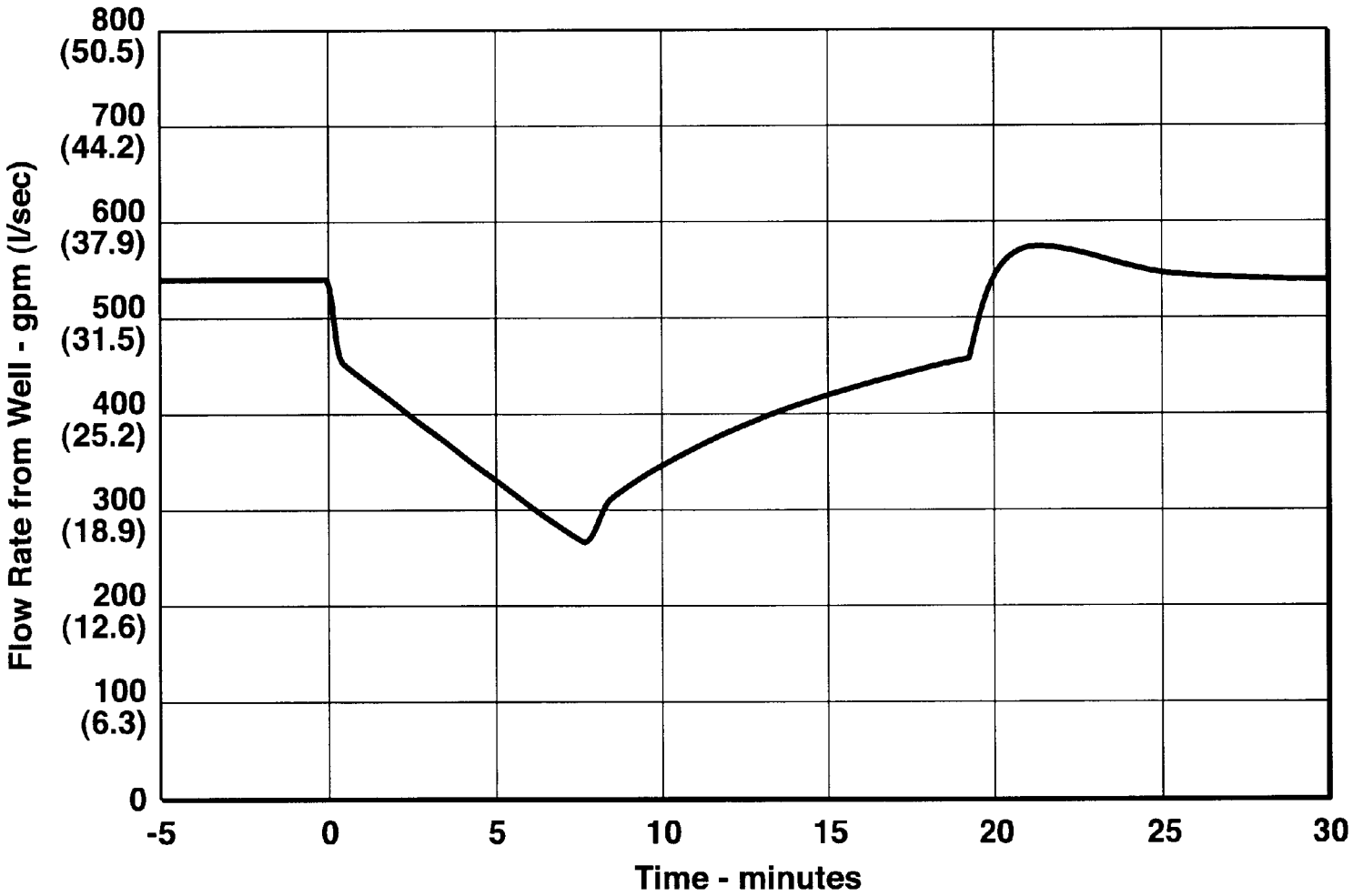
FIG. 3 shows a graph of the returning fluid flow rate with respect to time in an extended-reach well with a DGD system.

FIG. 3 shows an example graph of returning mud flow volume with respect to time to depict the return flow from a DGD well during and following a five minute shutdown of the mud pumps which is about the amount of time needed to make a typical drill string connection. This particular example is for a gas lift drilling riser, (GLDR), system, such as shown in FIG. 1. However, the invention may also be used with pump lift DGD systems, and the example graph shown in FIG. 3 is also applicable to such systems. Prior to mud pump shut down, at time 0 minutes on the graph of FIG. 3, drilling mud was circulated at 540 gpm (gallons per minute) (34 l/sec). The rapid reduction in flow to about 460 gpm (29 l/sec) is a result of the loss of mud pump pressure. The nearly linear subsequent flow decline is a result of decreasing hydrostatic imbalance as the mud level ((100) in FIG. 2*b*) falls within the drill string ((2) in FIG. 2*b*). Mud pumps were restarted at 540 gpm, 5 minutes after shutdown, and return flow began to increase at about 8 minutes after shutdown. The minimum flow rate during this transient was about 270 gpm (17 l/sec). If the mud pumps had not been restarted, flow would have continued to decline to zero at about 25 minutes after shutdown. The significance of the return mud flow rate will be further explained.

Figure 4:
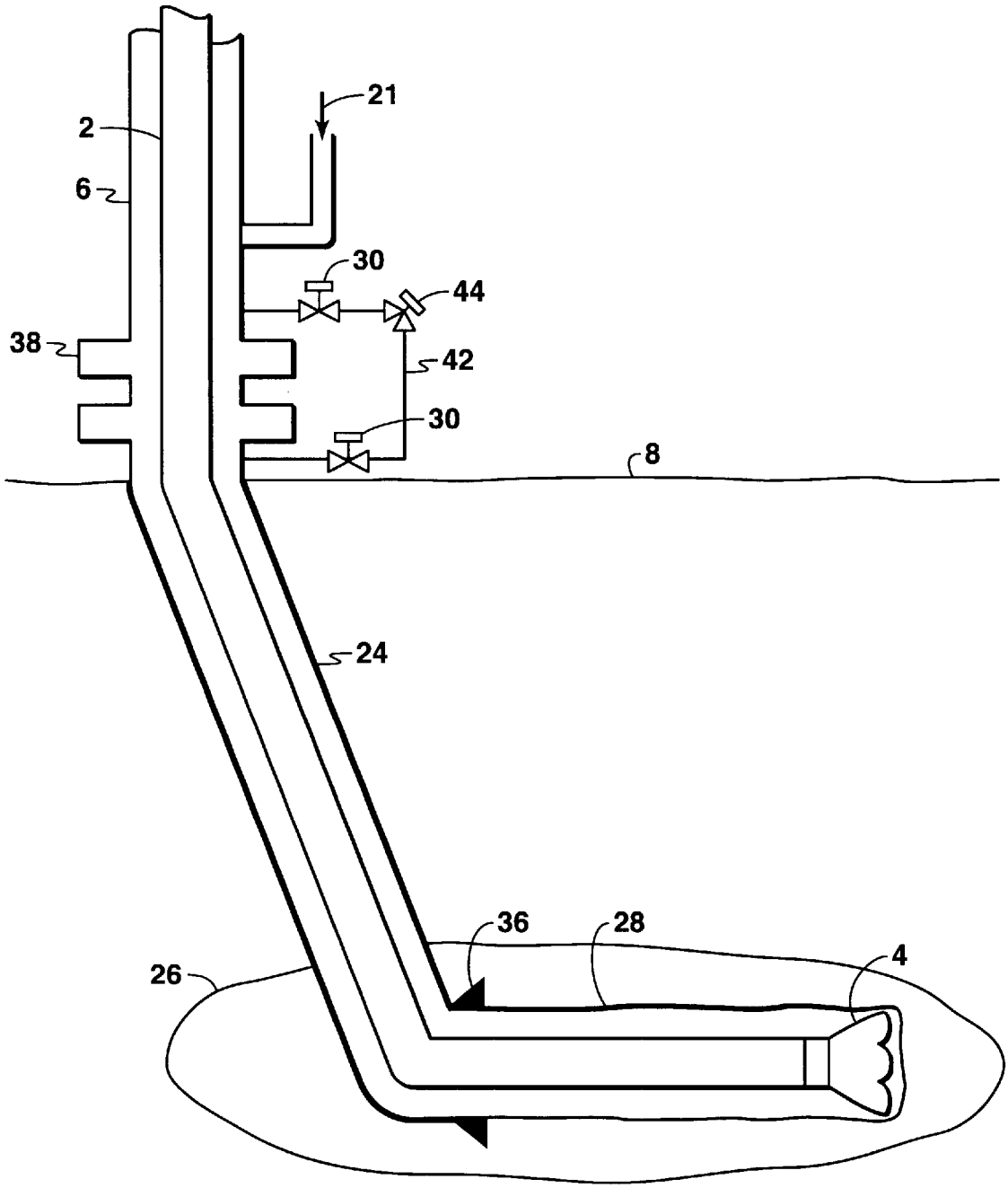
FIG. 4 shows a simplified illustration of an extended-reach well with a DGD system including a drilling riser, subsea blowout preventer stack, and valves forming part of a bypass conduit.

FIG. 4 is a simplified illustration of an extended-reach offshore well being drilled using DGD though a drilling riser (6) and a subsea blowout preventer (BOP) stack (38). To advance fluid flow up (20) the riser (6), gas (21) or other low density fluid is introduced at the lower end of the riser (6). Part of the wellbore may be depicted as being cased (24) with the remainder being a non-cased substantially horizontal segment (28). The segment between the cased wellbore (24) and the non-cased horizontal segment (28) may be curved to varying degrees gradually in both vertical and azimuthal directions and the open hole segment may be other than horizontal. The example of FIG. 4, and other examples which follow, are explained in terms of offshore wells, because it is in deepwater offshore well drilling that DGD, and the method of the invention, are typically used.

FIG. 4 also illustrates a flow path (42), or bypass conduit, coupled hydraulically from below the BOP stack (38) to the base of the drilling riser (6) above it, bypassing the BOP stack (38). The bypass conduit (42) in this embodiment contains a remotely operable subsea choke (44) or throttling valve and several isolation valves (30). These components are part of the GLDR system and are otherwise used for well control in that system. Other types of DGD systems may include similar one or more bypass lines, multiple choke lines, or two in parallel. For example, in pump lift DGD systems, a mud return line couples the wellbore from below a rotating subsea diverter to the intake of a mud lift pump disposed generally near the sea floor. The mud return line may be throttled using a remotely operable choke or the like.

Figure 5:
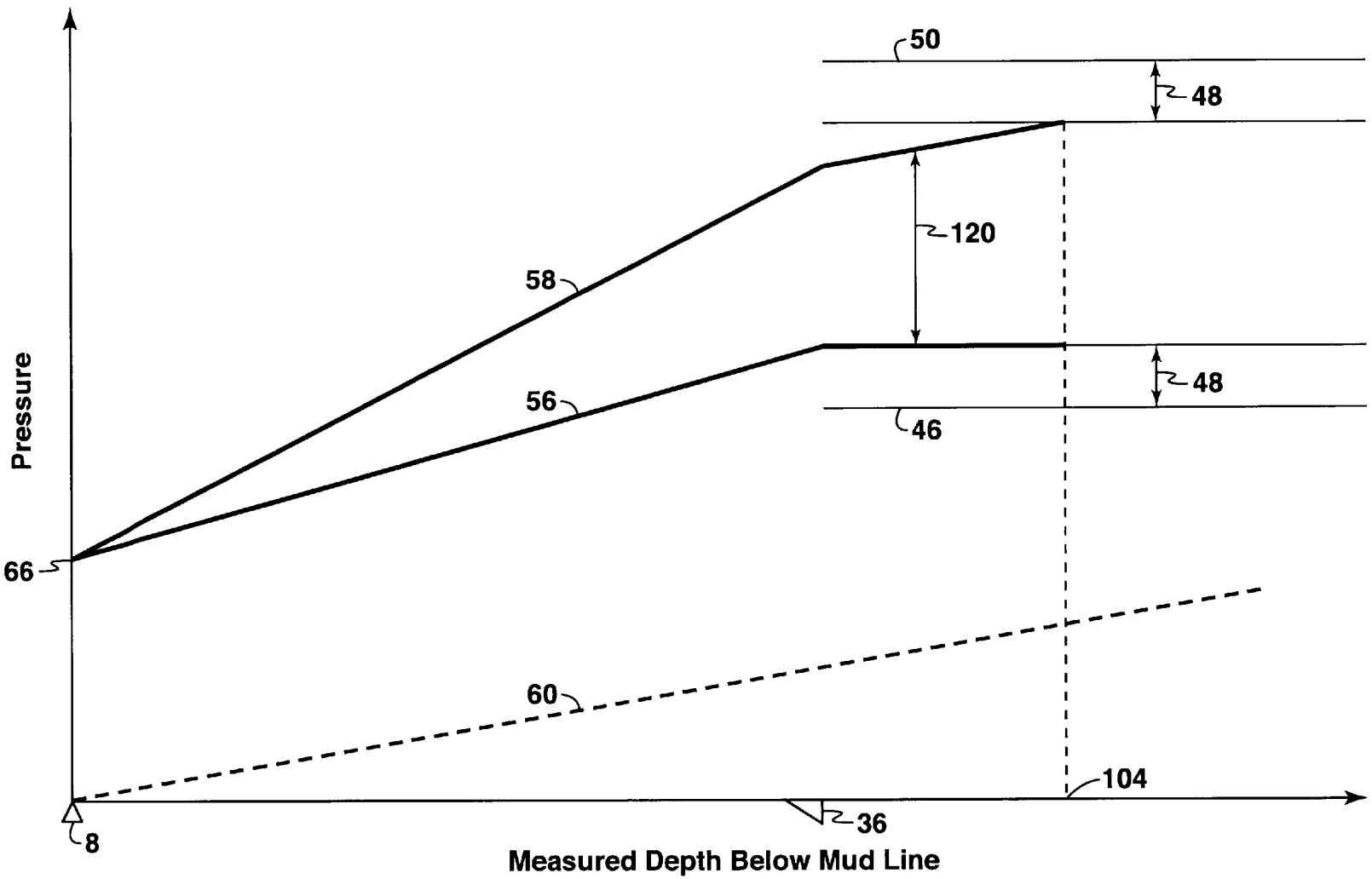
FIG. 5 shows a diagram of the pressure with respect to measured depth below the mud line in the wellbore of FIG. 4, without using the method of the present invention.

FIG. 5 shows a graph of the pressures in the wellbore of FIG. 4 without the benefit the present invention. Pressure is plotted as a function of the measured depth (along the trajectory of the well) below the mud line (8). FIG. 5 also shows the acceptable range of bottom hole pressures (120) in the open hole segment (28). This pressure range is explained as follows. Wellbore pressures must be maintained above the formation pore pressure, (46), plus an appropriate safety margin (48), and below the formation fracture pressure, (50), less an appropriate safety margin (48). This region represents the operable range of drilling pressure within limiting conditions of full circulating rate pressure, (58), and the static conditions after the "mud fall" effect has ceased, (56). At the mud line (8), the pressure in the casing annulus, is maintained constant and generally equal to the surrounding seawater pressure (66) during drilling by the DGD system. Under static conditions, the wellbore pressure (56) increases with measured depth according to the hydrostatic gradient of the mud until it reaches the start of the horizontal segment, which in this example, is at the casing seat (36). The wellbore pressure remains constant throughout the horizontal segment ((28) in FIG. 4). FIG. 5 illustrates that, under static conditions, the mud weight has been chosen to produce the minimum allowable pressure in the open hole. Under circulating conditions, the wellbore pressure (58) increases by the amount of the annulus friction pressure, (AFP) (60), shown in the lower part of FIG. 5. This can be tolerated as long as the circulating pressure (58) does not exceed the margin (48) on the fracture pressure (50). The point along the length of the wellbore at which this occurs is shown as the drilling limit (104). At the limit (104), an additional casing string must be set in order to continue drilling safely. However, when casing is set, additional drilling may be difficult or may not be possible, especially in highly inclined or horizontal wells. As a result, the drilling limit (104) may represent the maximum safe depth for such a well.

In the previous example, it is assumed that the BOPs ((38) in FIG. 4) remain open throughout drilling operation because a GLDR is used. The present embodiment involves closure of the BOP ((38) in FIG. 4) and use of a subsea choke ((44) in FIG. 4), as will be further explained.

Figure 6:
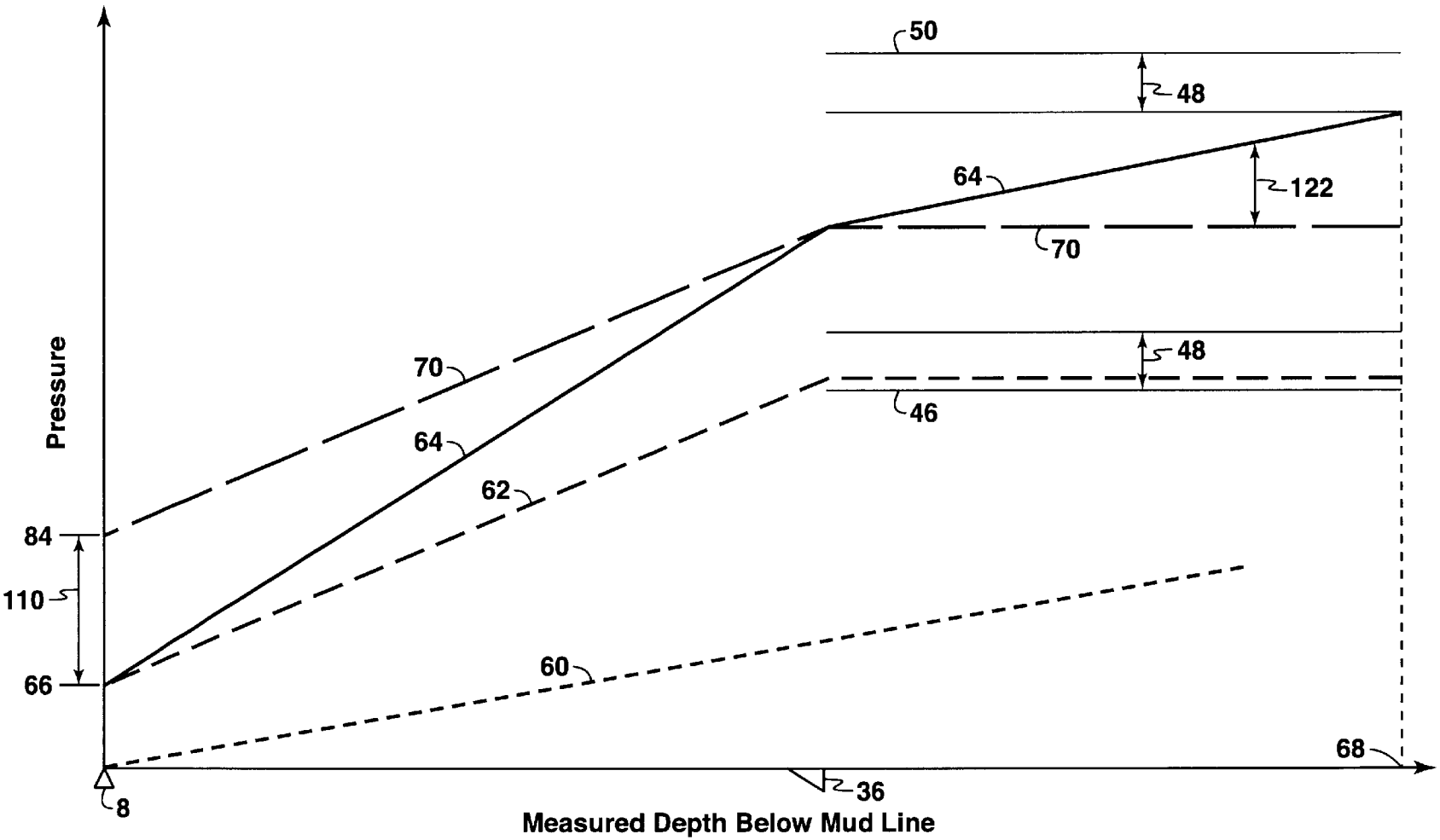
FIG. 6 shows a diagram of the pressure with respect to measured depth below the mud line in the wellbore of FIG. 4 using the method of the present invention.

In FIG. 6, the mud weight is less than in the previous example as illustrated by curve (62). As shown, this would result in pressures in the open hole segment less than the minimum allowable under static conditions. However, the operations described below prevent this occurrence, particularly during operations such as making drill string connections.

Under circulating conditions, in FIG. 6, the circulating pressure (64) increases from seawater pressure (66) at the mud line (8) to the pressure at the casing shoe (36) as a result of the combined effects of the hydrostatic and annular friction pressure (AFP) gradients (60). The hydrostatic gradient is less than in the previous example due to the lower mud weight. Therefore, the value of circulating pressure (64) at the casing seat (36) is less than shown in FIG. 5. Circulating pressure (64) increases along the length of the open hole segment by the amount of the AFP (60) in this part of well. The AFP (60) gradient as illustrated in FIG. 6 is shown as being the substantially the same as shown in FIG. 5 because the higher circulating rate needed to assure adequate hole cleaning will tend to offset any reduced frictional effects of lower viscosity which may be a property of less-dense mud. Because the circulating pressure (64) starts at a lower pressure at the casing seat (36), the circulating pressure (64) does not intersect the maximum allowable pressure in the wellbore until it reaches a greater drilling limit (68) than the one shown in FIG. 5. This allows drilling to longer lateral reaches without setting casing or terminating drilling.

Referring back to FIG. 4, prior to shutting down the mud pumps (not shown) for a drill string connection or other reason, the isolation valves (30) will be opened to provide the bypass flow path (42) around the BOP stack (38). The BOP (38) is then closed to cause the return mud flow to pass through the bypass (42) which includes the choke (44). The mud pumps (not shown) are then shut down. Note that in pump-lift DGD systems, a rotating subsea diverter (not shown) will already be closed to divert mud from the wellbore annulus to a mud return line (not shown).

As the return flow from the well declines, the subsea choke (44) is remotely controlled to compensate for the resulting decline in the annulus friction pressure in the wellbore. As shown in FIG. 6, the choke ((44) in FIG. 4) is controlled to maintain a substantially constant wellbore pressure at the casing seat (36). If the pump shut down is of short duration, such as illustrated in FIG. 3, return flow will not decline to zero and the wellbore pressures will remain within the operable range (122 in FIG. 5). Operation of the choke ((44) in FIG. 4) will serve to reduce the rate of the mud fall in the drill string because the flowing pressure drop through the choke ((44) in FIG. 4) will resist some of the hydrostatic pressure imbalance. If the mud pumps (not shown) are not restarted, the ultimate condition is represented by the static pressure curve (70). In this condition, the choke (44) in FIG. 4) is fully closed, circulation has ceased and the remaining hydrostatic imbalance is providing the necessary pressure drop (110) across the choke ((44) in FIG. 4). Note, in FIG. 6, that maintaining a constant wellbore pressure at the casing seat (36) causes the static pressure (70) and circulating pressure (64) to intersect at the casing seat depth. The static pressure 70 at the mudline 8 is pressure 84.

Figure 7:
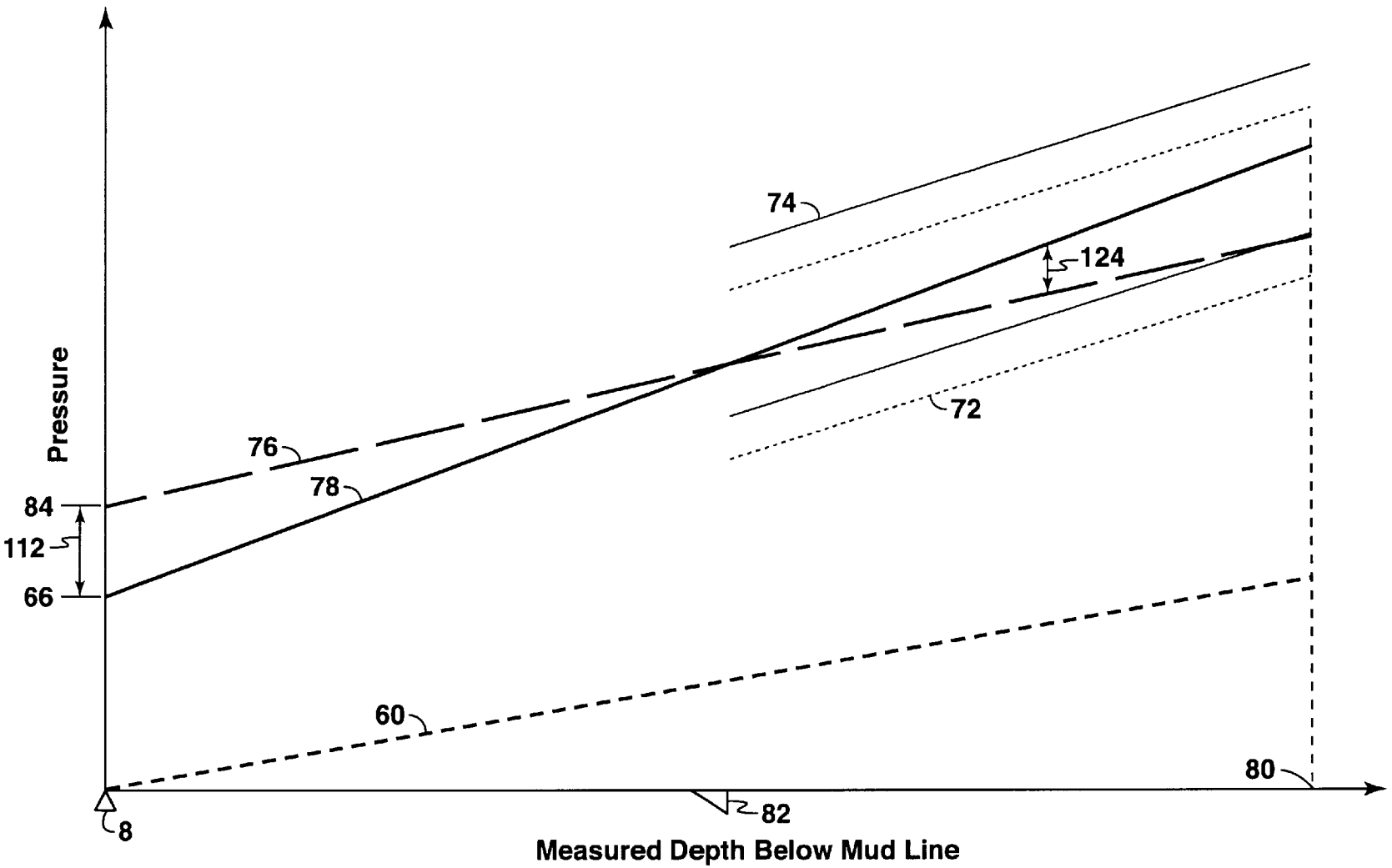
FIG. 7 shows a diagram of the pressure with respect to measured depth below the mud line in the wellbore, using the method of the present invention, in which the open hole portion of the well is inclined at about the same angle as the cased hole portion of the well shown in FIG. 4.

The example described above is for the purpose of describing a case in which the open hole segment ((28) in FIG. 4) is substantially horizontal. However, the same principles apply to other drilling situations. FIG. 7 represents a case in which the open-hole segment ((28) in FIG. 4) of the wellbore is inclined at substantially the same angle as the cased hole. In this instance, the pore pressure (72), fracture pressure (74), static pressure (76), and circulating pressure (78) all increase with measured depth in the open hole segment as a result of increasing vertical depth. The slopes (gradients) of the pore pressure (72) and fracture pressure (74) curves can vary significantly, depending on geological conditions and hole angle (inclination angle of the wellbore). For the case illustrated in FIG. 7, the full circulating (78) and static (76) pressure curves are controlled using the subsea choke ((44) in FIG. 4) as for the case illustrated in FIG. 6. However, the drilling limit (80) occurs when the static pressure (76) reaches the margin on the pore pressure (72) rather than when the circulating pressure (78) reaches the margin on the fracture pressure (74), as in FIG. 6. This limit (80) can be extended in the case of FIG. 7 by increasing the depth at which the wellbore pressure is maintained substantially constant. By shifting this "crossing point" to a measured depth below the casing seat (82), the static pressure (76) will be increased in the open hole. A higher pressure drop across the subsea choke ((44) in FIG. 4) will achieve this increase in "constant pressure depth".

To properly control the subsea choke ((44) in FIG. 4) to maintain a constant or nearly constant pressure at the casing seat, or other selected point in the wellbore, it is necessary that the constant pressure at the selected point in the wellbore be approximately known or be predictable for all flow conditions from static to the full circulating rate. If the return flow rate from the well can be determined, then the AFP (60) between the mud line and the casing seat (82) or other point can be computed based on this flow, the rheological properties of the drilling mud and the annular geometry of the wellbore in this interval. DGD systems known in the art have or can incorporate methods of determining the AFP based on this flow rate essentially in real time. The choke ((44) in FIG. 4) can then be controlled to cause the casing annulus pressure (84) to increase by an amount equal to the computed reduction in the casing seat pressure.

The above description of this invention is generally applicable to any DGD system, regardless of the method used to maintain wellbore annulus pressure at the mud line substantially equal to ambient seawater pressure. It is particularly applicable to DGD systems that employ gas or some other diluent to lighten a column of mud in the drilling riser. The pressure at the base of the riser is a result of the integrated density of fluid column within the riser. This pressure is inherently slow to respond to changes in flow conditions at the base of the riser, making it difficult to vary the pressure at the base of the riser, RBP, during relatively rapid transients such as encountered during and following drill string connections. Furthermore, it is also desirable to maintain RBP as constant as possible during drilling operations. Therefore, control of RBP is not practical during drill string connections and other short-term circulation transients to achieve the adjustments in wellbore pressure necessary to compensate for changes in AFP. The slow response of RBP makes the invention practical.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A method of controlling the pressure in a wellbore during a sub sea drilling operation, comprising:

operating a drilling system to have a first fluid pressure gradient inside a drill string extending from the sea surface to a drill bit near the bottom of the wellbore, the drilling system having a second fluid pressure gradient lower than the first fluid pressure gradient in a fluid return path extending from a selected depth in the wellbore to the sea surface;

determining the second fluid pressure at the selected depth in the wellbore;

stopping introduction of drilling fluid to the inside of the drill string; and during discontinuance of introduction of drilling fluid to the inside of the drill string, selectively controlling fluid flow in the fluid return path to maintain a substantially constant pressure of the fluid in the fluid return path at the selected depth in the wellbore.

2. The method of claim 1 wherein the second fluid pressure gradient is generated by introducing gas into the fluid return path at a selected depth in the wellbore.

3. The method as defined in claim 2 wherein the selectively controlling comprises closing a blowout preventer adapted to seal an annular space between the wellbore and the drill string, the annular space forming the fluid return path; and remotely operating an adjustable choke disposed in a bypass line between a point below the blowout preventer and a point above the blowout preventer.

4. The method as defined in claim 1 wherein the second fluid pressure gradient is generated by pump lifting fluid in the fluid return path between the selected depth and the earth's surface.

5. The method as defined in claim 1 wherein the selected depth is substantially equal to a casing seat depth.

6. The method as defined in claim 1 wherein the selected depth is greater than a casing seat depth.

7. The method as defined in claim 1 wherein a static fluid pressure at the bottom of the wellbore is less than an expected formation fracture pressure.

8. The method as defined in claim 1 wherein a portion of the wellbore is substantially horizontal.

* * * * *